US007140143B1

(12) United States Patent
Ivey

(10) Patent No.: US 7,140,143 B1
(45) Date of Patent: Nov. 28, 2006

(54) ADJUSTABLE RIFLE SCOPE MOUNT

(76) Inventor: Stephen Ivey, 822 Spike Trail, Murfreesboro, TN (US) 37129

( * ) Notice: Subject to any disclaimer, the term of this patent is extended or adjusted under 35 U.S.C. 154(b) by 61 days.

(21) Appl. No.: 11/032,705

(22) Filed: Jan. 11, 2005

(51) Int. Cl.
*F41G 1/387* (2006.01)

(52) U.S. Cl. ..... 42/125

(58) Field of Classification Search ..... 42/124, 42/125, 126, 148; 89/37.04
See application file for complete search history.

(56) References Cited

U.S. PATENT DOCUMENTS

| | | | | |
|---|---|---|---|---|
| 2,641,057 | A * | 6/1953 | Moore | 42/127 |
| 2,663,083 | A * | 12/1953 | Harms | 42/126 |
| 3,406,455 | A | 10/1968 | Akin, Jr. | |
| 3,471,932 | A * | 10/1969 | Luning | 42/126 |
| 4,026,054 | A | 5/1977 | Snyder | |
| 4,317,304 | A | 3/1982 | Bass | |
| 4,660,289 | A * | 4/1987 | Wilhide | 42/125 |
| 5,086,566 | A | 2/1992 | Klumpp | |
| 5,144,752 | A * | 9/1992 | Boeke et al. | 42/126 |
| 5,400,539 | A * | 3/1995 | Moore | 42/127 |
| 5,428,915 | A * | 7/1995 | King | 42/126 |
| 5,787,630 | A | 8/1998 | Martel | |
| 6,295,754 | B1 | 10/2001 | Otteman et al. | |
| 6,418,657 | B1 | 7/2002 | Brown | |
| 6,481,146 | B1 | 11/2002 | Carrier, III | |
| 6,708,439 | B1 | 3/2004 | Laitala | |
| 6,732,987 | B1 * | 5/2004 | Wooten et al. | 248/229.1 |
| 6,772,550 | B1 | 8/2004 | Leatherwood | |
| 2003/0192224 | A1 | 10/2003 | Kirk | |
| 2004/0088898 | A1 | 5/2004 | Barrett | |

* cited by examiner

*Primary Examiner*—Michael J. Carone
*Assistant Examiner*—Susan C. Alimenti
(74) *Attorney, Agent, or Firm*—Waddey & Patterson, P.C.; Howard H. Bayless

(57) ABSTRACT

An adjustable mounting system for a telescopic scope includes an adjustable elevation mount formed from a scope ring and an adjustable sub-base. A clevis portion of the scope ring holds an elevation pin that is received by a vertical slot in the adjustable sub-base. An internally longitudinal bore is disposed though the adjustable sub-base and an externally threaded barrel disposed in an opening of the longitudinal bore. A cylindrical elevation cam having an angled slot is disposed in the longitudinal bore and includes a positioning rod that extends through a bore disposed through the barrel. The angled slot receives the elevation pin as it extends through the vertical slot of the adjustable sub-base. The positioning rod has a shoulder portion that receives a set of roller thrust bearings and has a threaded distal end. An internally threaded dial thimble extends over the positioning rod distal end and shoulder portion to engage the external threads of the barrel. A thimble locking nut engages the threaded distal end of the positioning rod so as to affix the dial thimble to the positioning rod. Bi-directional longitudinal travel of the elevation cam is accomplished by rotation of the dial thimble.

15 Claims, 4 Drawing Sheets

ADJUSTABLE RIFLE SCOPE MOUNT

BACKGROUND OF THE INVENTION

The present invention relates generally to an apparatus and method of attaching and aligning an optical targeting or alignment system to a base. More particularly, this invention pertains to an apparatus and method of attaching and aligning optical sighting systems to a ballistic launcher. Even more particularly, this invention pertains to an adjustable mounting system for a telescopic scope.

It is long known in the art to provide mechanical means for adjusting the elevation of sighting and ranging devices mounted to a base. Aiming or sighting devices, laser target illumination devices and laser ranging devices are commonly mounted to ballistic projectile launchers, such as rifles, to survey equipment, and to other apparatus requiring alignment along a longitudinal axis. Common aiming or sighting devices include various types of telescopic optical scopes. Other aiming or sighting devices include telescopic and non-telescopic thermal imaging scopes and telescopic and non-telescopic amplified light imaging optical scopes.

Adjustable mounting systems are frequently used to mount telescopic scopes, and other similar aiming devices, upon barrels of rifles or other similar firearms. The most common telescopic scopes are non-amplified, optical telescopic scopes having front and rear mounting points. Such a telescopic scope is attached by means of a mounting system to the barrel of a rifle in a configuration having the rear sight of the scope adjacent to the rifle's breach and the front sight of the scope directed toward the muzzle of the rifle. The scope's sighting axis is approximately aligned with the bore axis of the rifle and is adjusted vertically in elevation and adjusted laterally in windage such that the point of aim observed by the shooter is the point of impact of the projectile at the desired range. Other elevation and windage adjustments may be necessary based on number of well known factors including wind speed and direction, temperature, humidity, projectile shape and mass, and powder mass and burn characteristics. Since projectiles follow a ballistic path, adjustments of elevation may be a critical factor for hitting targets at ranges approaching the maximum range of the cartridge-rifle combination.

The range in elevation adjustments needed for telescopic scopes mounted to high powered sporting and military rifles frequently exceeds the range in elevation adjustments achievable by elevation and windage adjustment mechanisms incorporated within the telescopic scope itself. These internal adjustment mechanisms of most telescopic scopes are less accurate over the outer portion of their adjustment ranges. The internal adjustment mechanisms frequently are positioned such that a shooter in the firing position cannot easily reach the internal adjustment mechanisms and cannot readily read the adjustment markings. Additionally, the internal adjustment mechanisms of telescopic scopes may be inadvertently displaced by acceleration experienced during recoil and other shocks.

Adjustable mounting systems are used to mount telescopic scopes so as to provide for larger ranges of elevation adjustment and greater resistance to displacement of the elevation adjustment mechanism during recoil or other shocks. One such adjustable telescopic scope mounting system is shown in FIGS. 1 and 3. This mounting system (herein referred to as the "Ivey 50 MOA" mounting system) was developed by Stephen Ivey and manufactured by Ivey Design of Murfreesboro, Tenn. The Ivey 50 MOA mounting system is adjustable within 1.0 m.o.a. (minute-of-arc) graduations between 0 m.o.a. and 50.0 m.o.a.

The Ivey 50 MOA mounting system includes an adjustable elevation mount 14 as the front mount and a pivoting mount 12 as the rear mount. The adjustable elevation mount 14 includes an adjustable sub-base 26 and the pivoting mount 12 includes a fixed sub-base 28. Each sub-base 26, 28 and corresponding base clamp 48, 50 are positioned upon the base rail 56 and are fixedly held in position by rail clamp bolts 52 positioned through each sub-base 26, 28 and corresponding base clamp 48, 50 and fastened with rail clam nuts 54. The base rail 56 is in turn rigidly attached to the rifle barrel or action. The Ivey 50 MOA mounting system may be adapted to fit various types of bases, including flat bases, dovetail bases and Picantinny bases among others.

The pivoting and adjustable mounts 12, 14 each include an upper assembly, commonly referred to as scope rings, having support bearings with an internal diameter approximately the same as the diameter of the telescopic scope at its mounting points. These scope rings each include an upper ring cap 20 that is fastened to the lower ring portion 22 by ring bolts so as to rigidly hold the telescopic scope to the support bearings. The lower portion 22 of each scope ring further includes a clevis 23 portion forming a clevis opening adapted to receive a portion of a sub-base 26, 28. For each scope ring, the lower ring portion 22 and the sub-base 26, 28 are bolted to form a clevis connection. The adjustable elevation mount 14 and a pivoting mount 12 form a rigid assembly when holding a telescopic scope.

The pivoting mount 12 of the Ivey 50 MOA mounting system is proximate the rear sight of the telescopic scope when a scope is mounted on a rifle. The lower ring portion 22 of this mount has two clevis pivot holes 106 that are aligned with the base pivot hole 107 of the fixed sub-base 28. These holes form a through hole that is closely sized in diameter to the diameter of a pivot pin bolt 30 extending through these holes and fastened with a nut. This type of clevis connection allows the scope ring of the pivoting mount 12 to pivot around the pivoting mount 12 upon loosening of the clevis connection.

The adjustable elevation mount 14 is proximate the front sight of the telescopic scope. The lower ring portion 22 of this mount has two clevis pivot holes 106 that are aligned with the vertical slot 108 (not shown in FIG. 1, but as shown in FIG. 4) of the adjustable sub-base 26. Referring again to FIG. 1, an elevation pin 31 extends through the clevis pivot holes 106 and the vertical slot 108 and is fastened with a nut. This clevis connection allows the scope ring of the adjustable elevation mount 14 to travel along a vertical direction shown by arrow 104 upon loosening of the clevis connection.

The adjustable elevation mount 14 includes a cylindrical bore disposed longitudinally through the adjustable sub-base 26 and having a first internally threaded opening receiving a locking setscrew 42. A second internally threaded opening receives an externally threaded barrel 40. The barrel has an internally threaded barrel bore that receives a threaded and extending portion of a micrometer head 39. The locking setscrew 42 and the extending portion of the micrometer head 39 are disposed in opposition.

An elevation cam 36 is slidably disposed in the cylindrical bore between the locking setscrew 42 and the extending portion of the micrometer head 39. The elevation cam 36 has a cylindrical body with flat faced ends and an angled slot 110 cut laterally through the cylindrical body. The angled slot 110 receives the elevation pin 31 as it extends through the vertical slot 108 of the adjustable sub-base 26. The locking setscrew 42 and the extending portion of the micrometer head 39 are each in contact with but not affixed to a flat faced end of the elevation cam 36. Adjustments of the locking setscrew 42 and the micrometer head 39 position the elevation cam 36 along a longitudinal direction of travel shown by arrow 102. The angled slot 110 is adapted to provide a track for forcing the elevation pin 31 to travel vertically when the elevation cam 36 is moved past the elevation pin 31, thus lowering and lifting the sight ring of the adjustable elevation mount 14.

Elevation adjustment of the Ivey 50 MOA mounting system is accomplished by using hex key wrenches to loosen the pivot pin 30 and the elevation pin 31 fixing nuts connecting the scope rings to the sub-bases 26, 29 on the pivoting and adjustable mounts 12, 14, respectively. A hex key wrench is then used to loosen the locking setscrew 42 butted to the rear of the elevation cam 36 so as to allow travel of the elevation cam 36. The micrometer head 39 is adjusted to a new, selected position. The locking setscrew 42 is retightened against one face of the elevation cam 36 so as to reposition the elevation cam 36 in firm contact against the opposing the micrometer head 39. Finally the pivot pin 30 and the elevation pin 31 are retightened using hex key wrenches.

The Ivey 50 MOA mounting system and other prior art systems have several disadvantages when used in demanding environments. First, elevation adjusting dials of many are exposed. For the Ivey 50 MOA mounting system the micrometer head extends in front of the mounting system and the corresponding elevation adjusting dials of other prior art systems extend laterally from their mounting systems. When hunting in rough terrain, obstacles may strike these exposed elevation adjusting dials and cause movement and misadjustment of the elevation adjustment set in the mounting system. Loss of an external tool would render the adjustment mechanisms unusable until such time as a new tool can be procured. Use of external tools, such as hex wrenches, is disadvantageous when it is necessary to make an elevation adjustment quickly, quietly and with a minimum of motion. Finally, when a shooter is in the shooting position it is very difficult to make an elevation adjustment to the mounting system without movement out to the shooting position.

The Ivey 50 MOA mounting system is susceptible to interrupted or incorrect positioning of the elevation cam 36 if either the locking setscrew 42 or the micrometer head extending portion 39 do not fully and firmly contact the elevation cam 36. Oil, dirt or debris may create an physical offset between a flat face of the elevation cam 36 and either of these positioning means. Such an offset causes small variations in vertical travel of the scope ring of the adjustable elevation mount 14 and, thus, causes a reduction in the smoothness, accuracy and precision of the elevation adjustment.

What is needed, then, is an adjustable mounting system for a telescopic scope that provides an elevation adjustment dial adapted to be used while the shooter is in the shooting position, that provides a means for making elevation adjustments quickly, quietly and with a minimum of motion, that provides a means for making elevation adjustment without the use of external tools (tool-less elevation adjustments) and provides an elevation adjustment dial that is protected from obstacles.

Additionally, what is needed is an adjustable mounting system for a telescopic scope that provides for smooth, accurate and precise transmission of bi-directional travel of the elevation cam mechanism within the bore of the adjustable sub-base and so as to prevent oil, dirt or debris from distorting the positioning of the elevation cam mechanism by the elevation adjustment dial.

BRIEF SUMMARY OF THE INVENTION

The present invention includes an adjustable mounting system for a telescopic scope having an adjustable elevation mount formed from a scope ring and an adjustable sub-base. A clevis portion of the scope ring holds an elevation pin that is received by a vertical slot in the adjustable sub-base. An internally threaded longitudinal bore is disposed through the adjustable sub-base and an externally threaded barrel is disposed in an opening of the longitudinal bore. A cylindrical elevation cam having an angled slot is disposed in the longitudinal bore and includes a positioning rod that extends through a bore disposed through the barrel. The angled slot receives the elevation pin as it extends through the vertical slot of the adjustable sub-base. The positioning rod has a shoulder portion that receives a set of roller thrust bearings and has a threaded distal end. An internally threaded dial thimble marked with graduations about its circumference extends over the positioning rod distal end and shoulder portion to engage the external threads of the barrel. A thimble locking nut engages the threaded distal end of the positioning rod so as to affix the dial thimble to the positioning rod. Bi-directional longitudinal travel of the elevation cam is accomplished through bi-directional rotation of the dial thimble. Measurements of the adjustment of the dial thimble are provided by horizontal and vertical lines marked on the barrel body and corresponding to revolutions of the dial thimble that indicated the position of the elevation cam in minutes-of-angle (m.o.a.).

An alternative embodiment of the adjustable mounting system of the present invention includes an elevation cam adapted to receive a floating angular cut wedge plunger adapted to engage the elevation pin during elevation adjustments so as to provide continuous engagement of the elevation pin by a wedge face. The wedge plunger is spring biased and disposed within a bore in the elevation cam penetrating from the flat surface opposite the positioning rod into the angled slot. Additionally, a spring biased floating button is disposed in an access bore in the bottom of the adjustable sub-base. The access bore penetrates to the longitudinal bore housing the elevation cam. The floating button is disposed adjacent to the lower surface of the elevation cam and exerts a bias forcing the elevation cam into continuous contact with the upper surface of the longitudinal bore.

Accordingly it is an object of the present invention to provide an adjustable mounting system for a telescopic scope having an elevation adjustment dial adapted to provide smooth and accurate transmission for bi-directional travel of the elevation cam.

It is an additional object of the present invention to provide an adjustable mounting system for a telescopic scope having an elevation adjustment dial adapted to be used while the shooter is in the shooting position, adapted to make elevation adjustments quickly, quietly and with a minimum of motion, and adapted to be protected from obstacles.

Finally, it is an object of the present invention to provide an adjustable mounting system for a telescopic scope having an elevation adjustment dial adapted for making elevation adjustment without the use of external tools (tool-less elevation adjustments).

DETAILED DESCRIPTION OF THE INVENTION

Figure 1:
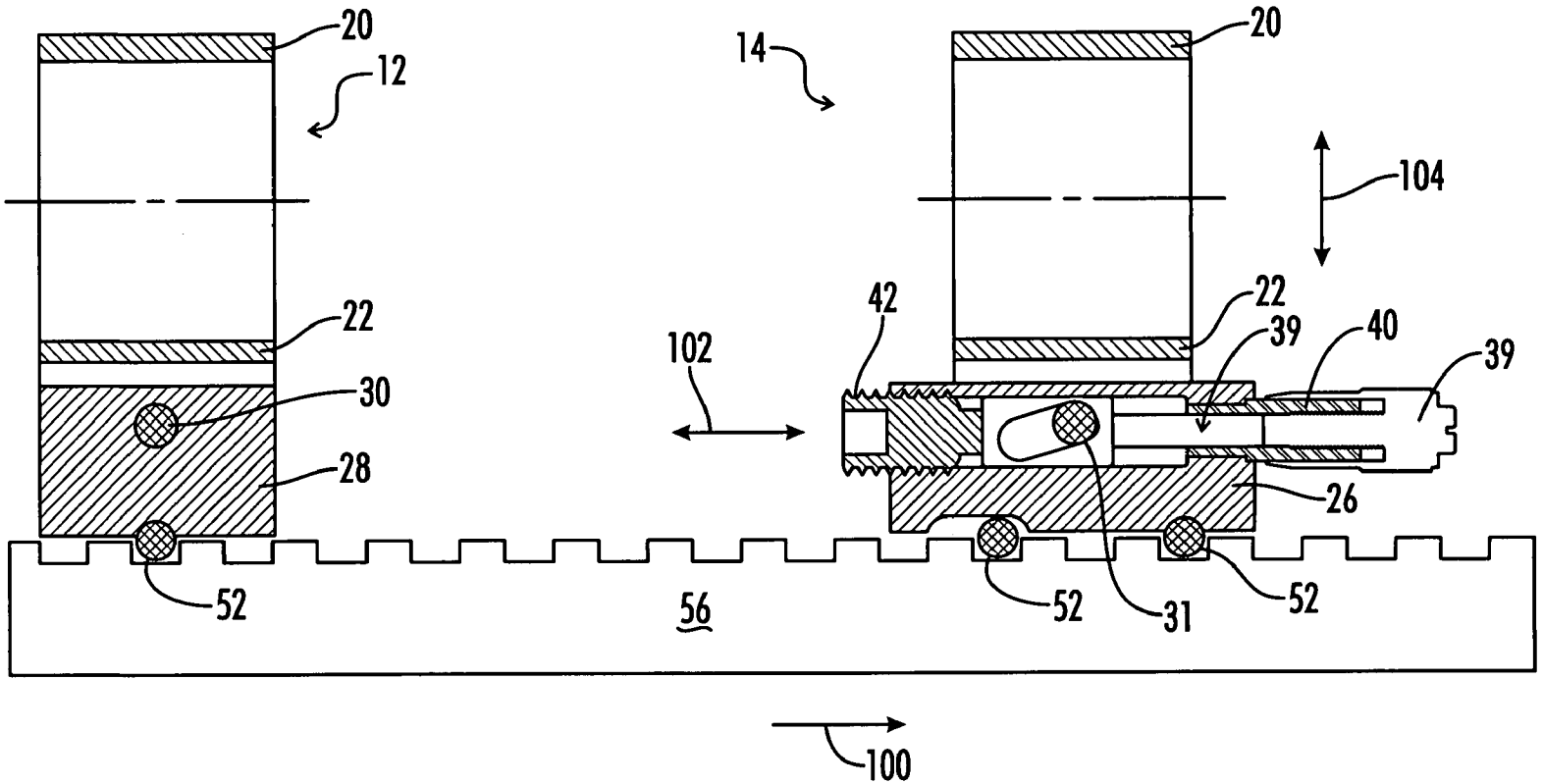
FIG. 1 (PRIOR ART)
FIG. 1 is a longitudinal cross-sectional view of a prior art adjustable mounting system for a telescopic scope.
Figure 2:
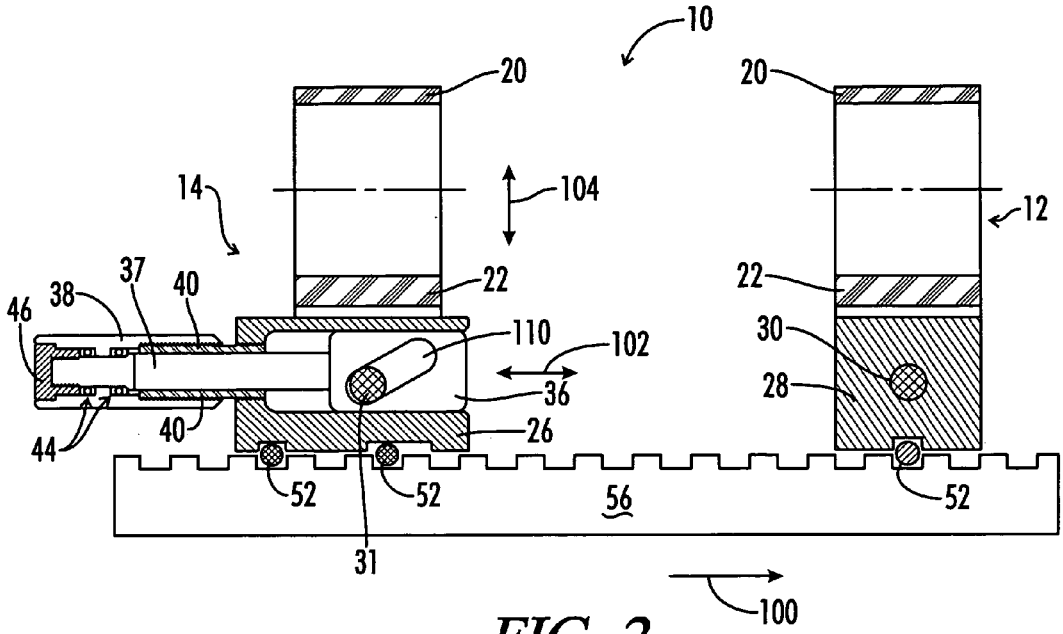
FIG. 2 is a longitudinal cross-sectional view of one embodiment of the adjustable mounting system of this invention.
Figure 3:
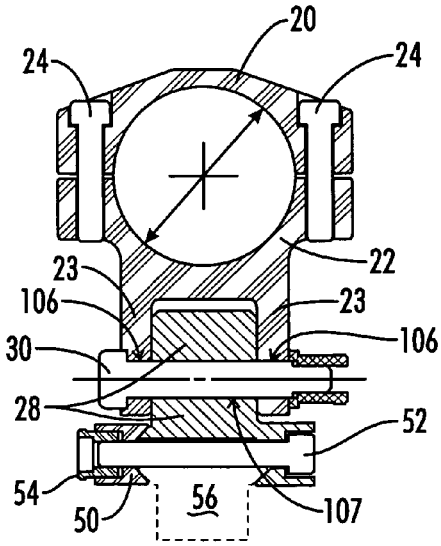
FIG. 3 is a transverse cross-sectional view of the pivoting mount shown in FIGS. 1 and 2.
Figure 4:
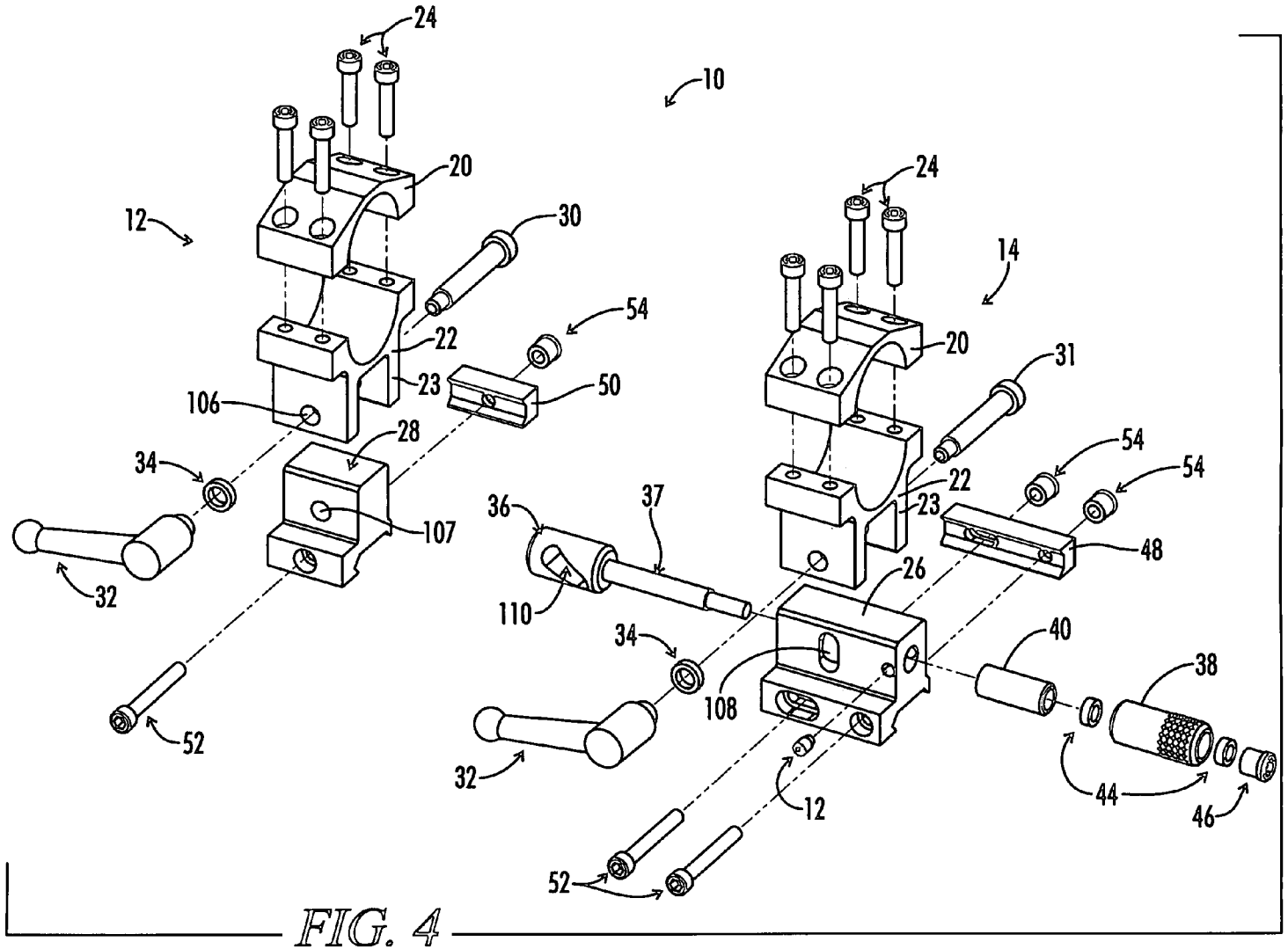
FIG. 4 is an exploded oblique reverse view of the adjustable mounting system shown in FIG. 2.

One preferred embodiment of the present invention is shown in FIGS. 2, 3 and 4. This embodiment of the mounting system 10 of the present invention is adjustable within 1.0 m.o.a. graduations between 0 m.o.a. and 150.0 m.o.a. This embodiment incorporates the scope rings and pivoting mount 12 of the Ivey 50 MOA mounting system, with the exception that a ratchet lever 32 is used to tighten or loosen the pivot pin 30. This modification allows for rapid, quiet tightening or loosening the pivot pin 30 without the use of external tools.

Referring to FIG. 2, the mounting system of the present invention includes a pivoting mount 12 located forward of the adjustable elevation mount 14 as indicated by the direction arrow 100. The elevation adjustment dial 38 is disposed in the rear portion of the adjustable elevation mount 14 and extends longitudinally further rearward. When in a shooting position, this configuration places the elevation adjustment dial adjacent to the shooter's eye and within easy reach of the shooter's hand. In this configuration, the elevation adjustment can easily be used to make elevation adjustments quickly, quietly and with a minimum of motion while the shooter remains in the shooting position. This configuration also places the adjustment dial 38 in a protected position between the rifle and the mounted telescopic scope, and, thus, reduces the likelihood of the adjustment dial 38 being struck by an obstacle.

Referring now to FIGS. 2 and 4, one novel feature of the present invention is the adjustable elevation mount 14 formed from a scope ring and an adjustable sub-base 26. By mechanically capturing the elevation adjustment dial 38 to the elevation cam 36, the elevation adjustment dial provides bi-directional control of elevation adjustments of the adjustable telescopic mounting system of this invention.

This novel adjustable elevation mount 14 includes a scope ring attached to a sub-base 26 through a clevis connection. A clevis portion 23 of the scope ring has two clevis pivot holes 106 that are aligned with the vertical slot 108 of the adjustable sub-base 26. An elevation pin 31 extends through the two clevis pivot holes 106 and is received by a vertical slot 108 in the adjustable sub-base 26. The elevation pin 31 is fastened with a quick release ratchet leaver 32. This clevis connection allows the scope ring of adjustable elevation mount 14 to travel along a vertical direction shown by arrow 104 upon loosening of the clevis connection. The vertical travel of the scope ring of adjustable elevation mount 14 allows for elevation of the rear scope ring in an arc path pivoting about the single pivot pin 30 of the fixed sub-base assembly 28.

An internally threaded longitudinal bore is disposed though the adjustable sub-base 26 so as to intersect the vertical slot 108. In the embodiment shown, an externally threaded barrel 40 having a bore is affixed in the internally threaded rear opening of the longitudinal bore. A cylindrical elevation cam 36 having an angled slot 110 is disposed in the longitudinal bore. The cylindrical elevation cam 36 includes a positioning rod 37 that extends through the longitudinal bore and further extends through the barrel bore. The angled slot 110 receives the elevation pin 31 as it extends through the vertical slot 108 of the adjustable sub-base 26. The positioning rod 37 has a shoulder portion that receives a set of roller thrust bearings 44 and has a threaded distal end. An internally threaded dial thimble 38 marked with graduations about its circumference engages the external threads of the barrel 40. A thimble locking nut 46 engages the threaded distal end of the positioning rod. This thimble locking nut 46 forces the set of roller thrust bearings 44 against the shoulder portion of the positioning rod 37. The dial thimble 38 is thus rotably affixed to the positioning rod 37. In this configuration, bi-directional longitudinal travel of the elevation cam 36 is caused through bi-directional rotation of the dial thimble 38. The mechanical capturing of the thimble dial 38 to the elevation cam 36 provides bi-directional control of elevation adjustments of the adjustable telescopic mounting system of this invention. The elevation adjustment is determined by the travel of the elevation pin 31, which is vertically positioned in the vertical slot 108 by the corresponding longitudinal position of the angled slot 110 of the elevation cam 36. The rotation of the dial thimble 38 provides locomotion to the elevation cam 36, moving the position of the angled slot 110 in relation to the vertical slot 108 of the adjustable sub-base 26. This relative motion of the angled slot 110 and the vertical slot 108 results in vertical travel of the elevation pin 31 and of the scope ring of adjustable elevation mount 14. The vertical travel of the scope ring of the adjustable elevation mount 14 allows for elevation of the rear scope ring in an arc path pivoting about the single pivot pin 30 of the fixed sub-base assembly 28. Such captured bi-directional control of elevation adjustments results in increased accuracy, limited recoil effects, and simplified field adjustment mechanisms as compared to prior art systems, including the Ivey 50 MOA mounting system.

Measurements of the adjustments of the dial thimble 38 are provided by horizontal and vertical graduations marked on the barrel body 40 and corresponding to revolutions of the dial thimble 38. The graduations on the dial thimble 38 work in conjunction with the fixed graduations marked on the barrel 40 to provide repeatable "Vernier" type readings of the adjustment setting that indicated the position of the elevation cam 36 in minutes-of-angle (m.o.a.).

Figure 5:
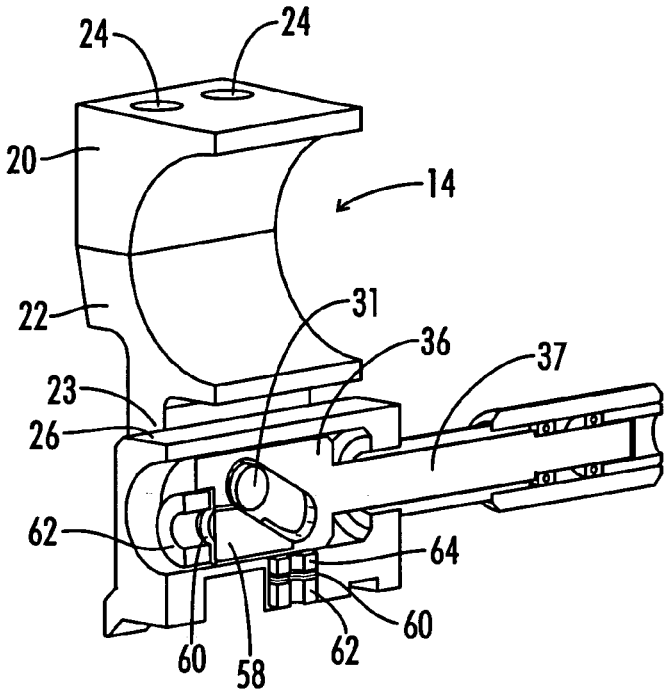
FIG. 5 is a longitudinal cross-sectional view of a detail of another embodiment of the adjustable mounting system of this invention.
Figure 6:
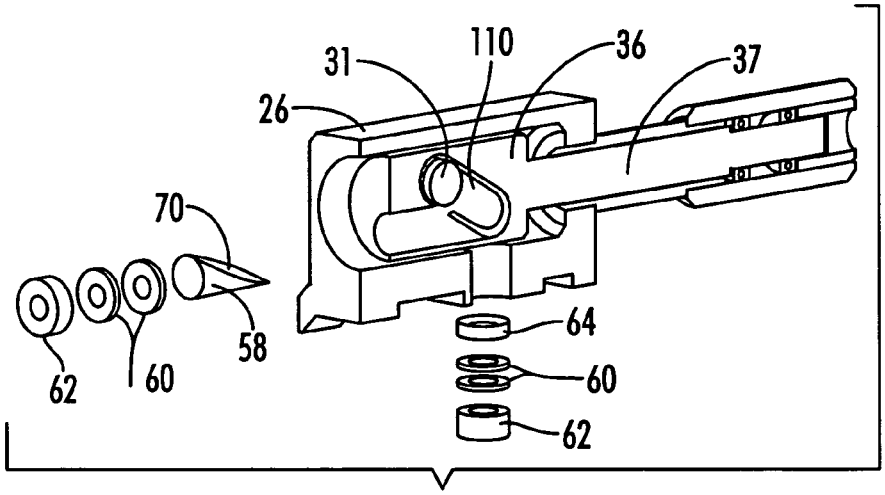
FIG. 6 is an exploded view of the adjustable mounting system shown in FIG. 5.

Referring now to FIGS. 5 and 6, an alternate embodiment of the present invention is shown. The bi-directional elevation cam 36 has been modified to accept a floating angular-cut wedge plunger 58. A close fitting plunger bore is disposed in the elevation cam 36 such that the plunger bore penetrates into the angular slot 110. The wedge plunger 58 has a wedge face 70 with a slope approximating the slope of the angular slot 110. The wedge plunger 58 is disposed in the plunger bore and extends into the angular slot 110. Spring washers 60 backed by a setscrew 62 provide an axial bias that forces the wedge plunger 58 into continuous contact with the elevation pin 31. This axial bias of the wedge plunger 58 pushes the elevation pin 31 against the opposite wall of the angled slot 110 and provides for continuous capture of the elevation pin 31 by the elevation cam 36 at all points throughout the travel of the elevation cam 36 during elevation adjustments. This additional capture feature improves repeatability and precision.

Additionally, a spring biased floating button 64 is disposed in an access bore in the bottom of the adjustable sub-base 26. The access bore penetrates to the longitudinal bore housing the elevation cam 31. The floating button 64 is disposed adjacent to the lower surface of the elevation cam 31 and exerts a bias force against the bottom of the elevation cam 31 so as to force the elevation cam into continuous contact with the upper surface of the longitudinal bore. The floating button 64 is biased by a set of spring washers 66 backed by a setscrew 62 of which pressure can be finely adjusted for optimum performance.

Advantageously, the continuous mechanical capture features of the wedge plunger 58 and of the floating button 64 combine to provide improved repeatability and precision. In one example, tests with an adjustable mounting system of this invention having the wedge plunger 58 and the floating button 64 resulted in a tolerance of +/−0.5 inches at a range of 100 yards. Without the wedge plunger 58 and the floating button 64 tests of the adjustable mounting system resulted in a tolerance of only +/−2.0 inches at a range of 100 yards.

The present invention contemplates similar mechanical capturing of a windage adjustment dial to a cylindrical windage cam to provide bi-directional control of windage adjustments of adjustable telescopic mounting systems. Such captured bi-directional control of windage adjustments would result in increased accuracy, limited recoil effect, and simplified field adjustment mechanisms.

The present invention also contemplates similar mounting systems for non-telescopic thermal imaging scopes and telescopic and non-telescopic amplified light imaging optical scopes, for other aiming or sighting devices, for laser target illumination devices and for laser ranging devices.

Thus, although there have been described particular embodiments of the present invention of a new and useful Adjustable Rifle Scope Mount, it is not intended that such references be construed as limitations upon the scope of this invention except as set forth in the following claims.

What is claimed is:

1. An adjustable mounting system for a sighting device, the system comprising an adjustable elevation mount including:

an adjustable sub-base having a vertical slot disposed laterally through the sub-base, the sub-base further having a cam bore disposed longitudinally within the sub-base so as to intersect the vertical slot;

an elevation cam assembly having an elevation cam and a positioning rod attached to the elevation cam, the elevation cam having an angled slot disposed laterally through the elevation cam, the elevation cam slidably disposed in the cam bore so as to position the angled slot adjacent to the vertical slot;

an elevation pin received through the vertical slot and through the angled slot, the vertical slot adapted to allow vertical travel of the elevation pin, the vertical slot and the angled slot cooperating to hold the elevation pin at a vertical position corresponding to the position of the elevation cam within the longitudinal bore; and an elevation adjustment dial attached to the positioning rod, the elevation adjustment dial adapted such that rotation of the dial causes longitudinal displacement of the elevation cam through the cam bore in a direction and distance determined by the direction and magnitude of dial rotation, said displacement of the elevation cam causing vertical displacement of the elevation pin within the vertical slot.

2. The system of claim 1, wherein the cam bore includes a barrel opening, wherein, the sub-base includes an externally threaded barrel extending from the barrel opening, the barrel having a barrel bore in communication with the cam bore, the positioning rod extending through the cam bore and the barrel bore, and wherein, the elevation adjustment dial is threadably engaged to the external threads of the barrel such that rotation of the elevation adjustment dial produces longitudinal displacement of the elevation adjustment dial along the barrel and thereby produces longitudinal displacement of the elevation cam though the cam bore in a direction determined by the direction of elevation adjustment dial rotation.

3. The system of claim 2, wherein the positioning rod comprises a shoulder portion and a threaded end, wherein, the shoulder portion receives a set of roller thrust bearings, the received roller thrust bearings contacting the exterior of the positioning rod and the interior bore of the elevation adjustment dial, and wherein a locking nut engages the threaded end so as to retain the roller thrust bearings upon the shoulder portion and prevent longitudinal movement of the positioning rod relative to the elevation adjustment dial.

4. The system of claim 3, wherein the barrel is externally marked with fixed graduations, the graduations corresponding to revolutions of the elevation adjustment dial, wherein the elevation adjustment dial is externally marked with graduations, and wherein, the graduations marked on the elevation adjustment dial, in cooperation with the fixed graduations marked on the barrel, provide measurement of the adjustment dial setting that indicates the position of the elevation cam.

5. The system of claim 1, further comprising:

a scope ring including a clevis portion, the scope ring adapted to fixedly hold a portion of a sighting device, the clevis portion having at least one elevation pin hole, the clevis portion receiving a portion of the sub-base, wherein the sub-base is adapted for affixing to a base, wherein the elevation pin is received through the at least one elevation pin hole so as to form a clevis connection, and wherein rotation of the elevation adjustment dial causes vertical displacement of the scope ring relative to the sub-base.

6. The system of claim 5, wherein the scope ring comprises an upper ring portion fastened to a lower ring portion, the lower ring portion comprising the clevis portion.

7. The system of claim 5, wherein the scope ring further comprises a quick release lever receiving and fastening the elevation pin, wherein the quick release lever provides for manual adjustment of elevation without the use of external tools.

8. The system of claim 5, the system further comprising a pivoting mount including:

a fixed sub-base having a pivot bore disposed laterally through the fixed sub-base, the fixed sub-base adapted for affixing to a base;

a pivot scope ring including a clevis portion, the pivot scope ring adapted to fixedly hold a portion of a sighting device, the clevis portion having at least one pivot pin hole, the clevis portion receiving a portion of the fixed sub-base; and a pivot pin received through pivot bore and through the at least one pivot pin hole so as to form a clevis connection.

9. The system of claim 8, wherein the system further comprises:

a sighting device held in the scope ring of the adjustable elevation mount and held in the scope ring of the pivot mount; and a base affixed to the adjustable sub-base and affixed the fixed sub-base, wherein, rotation of the elevation adjustment dial causes vertical displacement of the scope ring of the adjustable elevation mount, and wherein, said vertical displacement causes the scope ring of adjustable elevation mount to travel in an arc path pivoting about the pivot pin of the pivoting mount.

10. The system of claim 9, wherein the base is affixed to one of the barrel or the action of a firearm, the barrel having a muzzle, and wherein the elevation adjustment dial extends from the adjustable elevation mount and away from the muzzle.

11. The system of claim 5, wherein the sighting device comprises a telescopic scope.

12. An adjustable elevation mount comprising:

an adjustable sub-base having a vertical slot disposed laterally through the sub-base, the sub-base further having a cam bore disposed longitudinally within the sub-base so as to intersect the vertical slot;

an elevation cam assembly having an elevation cam and a positioning rod affixed to the elevation cam, the elevation cam having an angled slot disposed laterally through the elevation cam, the elevation cam slidably disposed in the cam bore so as to position the angled slot adjacent to the vertical slot;

an elevation pin received through the vertical slot and through the angled slot, the vertical slot adapted to allow vertical travel of the elevation pin, the vertical slot and the angled slot cooperating to hold the elevation pin at a vertical position corresponding to the position of the elevation cam within the longitudinal bore;

an elevation adjustment dial attached to the positioning rod, the elevation adjustment dial adapted such that rotation of the dial causes longitudinal displacement of the elevation cam through the cam bore in a direction and distance determined by the direction and magnitude of dial rotation, said displacement of the elevation cam causing vertical displacement of the elevation pin within the vertical slot; and a first biasing means providing for continuous contact of the elevation pin by the elevation cam at all points throughout the longitudinal travel of the elevation cam.

13. The apparatus of claim 12, the apparatus further comprising:

a second biasing means providing for continuous contact of the cam bore by the elevation cam at all points throughout the longitudinal travel of the elevation cam.

14. The apparatus of claim 12, the first biasing means comprising:

a plunger bore disposed in the elevation cam such that the plunger bore penetrates into the angular slot;

a wedge plunger disposed in the plunger bore and extending into the angular slot; and a first biasing spring forcing the wedge plunger against the elevation pin.

15. The apparatus of claim 12, the second biasing means comprising:

an access bore disposed in the bottom of the adjustable sub-base and extending into the longitudinal bore housing the elevation cam;

a floating button disposed in the access bore and extending into the longitudinal bore; and a second biasing spring forcing the floating button against the elevation pin.

* * * * *